US012630774B2

(12) United States Patent
Kellens et al.

(10) Patent No.: US 12,630,774 B2
(45) Date of Patent: May 19, 2026

(54) PROCESS FOR PRODUCING BIODIESEL WITH REDUCED MONOACYLGLYCEROL CONTENT

(71) Applicant: Desmet Belgium, Zaventem (BE)

(72) Inventors: Marc Kellens, Mechelen-Muizen (BE); Wim De Greyt, Sanaai (BE); Bárbara Sánchez González, Zaventem (BE); Dario Altera, Petaling Jaya (MY)

(73) Assignee: DESMET BELGIUM, Zaventem (BE)

( * ) Notice: Subject to any disclaimer, the term of this patent is extended or adjusted under 35 U.S.C. 154(b) by 0 days.

(21) Appl. No.: 18/863,788

(22) PCT Filed: May 19, 2023

(86) PCT No.: PCT/US2023/023024
§ 371 (c)(1),
(2) Date: Nov. 7, 2024

(87) PCT Pub. No.: WO2023/225377
PCT Pub. Date: Nov. 23, 2023

(65) Prior Publication Data

US 2025/0283006 A1 Sep. 11, 2025

Related U.S. Application Data

(60) Provisional application No. 63/343,551, filed on May 19, 2022.

(51) Int. Cl.
*C10L 1/02* (2006.01)

(52) U.S. Cl.
CPC ..... *C10L 1/02* (2013.01); *C10L 2200/0476* (2013.01)

(58) Field of Classification Search
CPC ..... C10L 1/02; C10L 2200/0476
See application file for complete search history.

(56) References Cited

U.S. PATENT DOCUMENTS

2017/0369803 A1 12/2017 Scott
2020/0199471 A1 6/2020 Campos

FOREIGN PATENT DOCUMENTS

CN 101302448 A 11/2008
WO WO-2009074307 A2 * 6/2009 ..... C07C 67/56
WO WO 2016/098025 A1 6/2016
WO WO 2018/210573 A1 11/2018

OTHER PUBLICATIONS

Dijkstra, "Some Thoughts on the Mechanism of Ester Interchange Reactions Involving Acylglycerols", Eur. J. Lipid Sci. Technol., 2020, vol. 122, 2000188, pp. 1-7.

(Continued)

*Primary Examiner* — Cephia D Toomer
(74) *Attorney, Agent, or Firm* — Birch, Stewart, Kolasch & Birch, LLP

(57) ABSTRACT

A post-treatment process for crude biodiesel containing residual monoacylglycerol (MAG) and including contacting said crude biodiesel with a concentrated alkaline solution, double counter-current washing each followed by a phase separation and drying. The process is economical in chemicals and washing water.

12 Claims, 1 Drawing Sheet

(56) References Cited

OTHER PUBLICATIONS

International Search Report, issued in PCT/US2023/023024, dated Sep. 8, 2023.
Kartika et al., "Biodiesel production from jatropha seeds: Solvent extraction and in situ transesterification in a single step", Fuel, 2013, vol. 106, pp. 111-117.
Written Opinion of the International Searching Authority, issued in PCT/US2023/023024, dated Sep. 8, 2023.

* cited by examiner

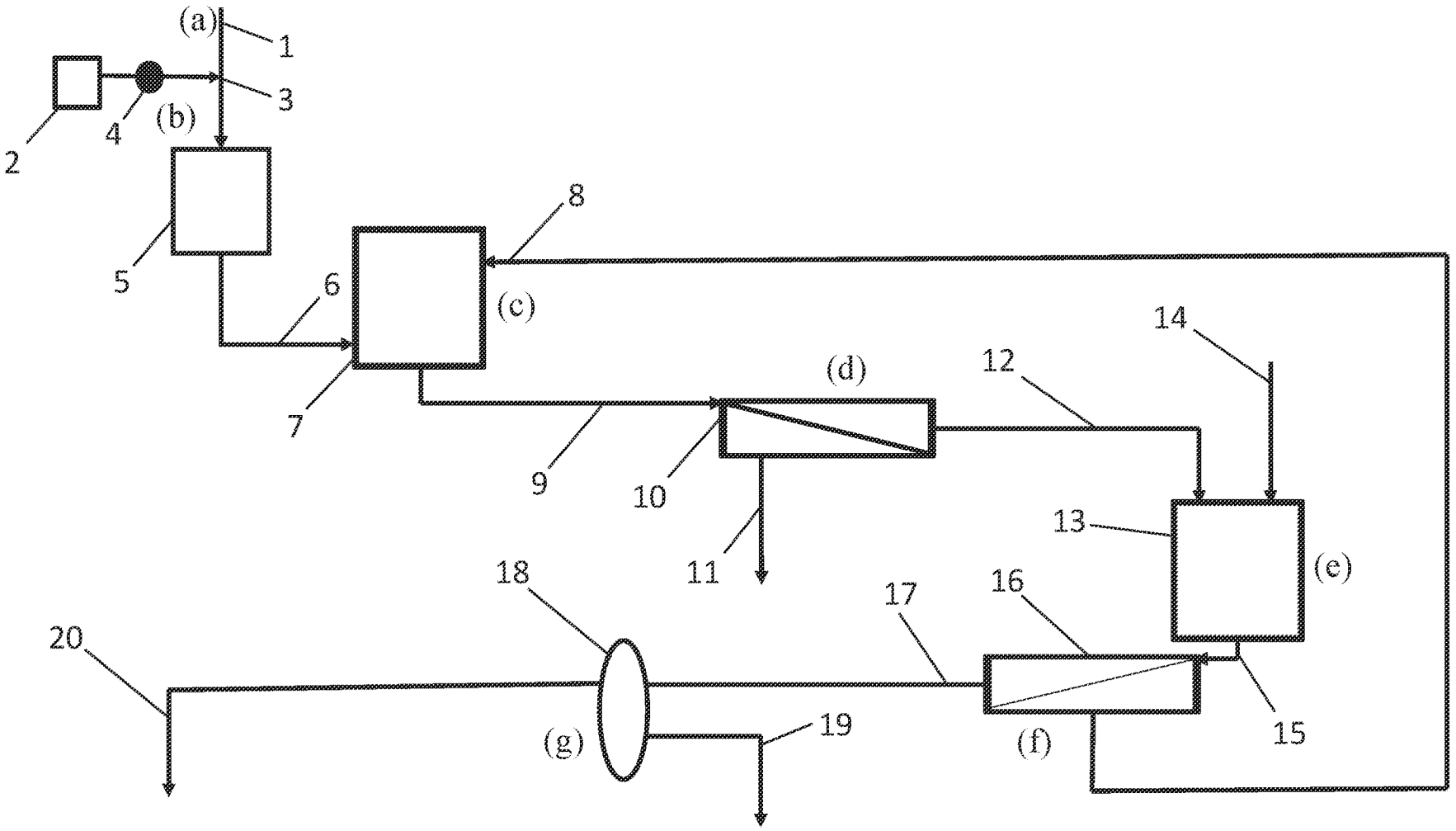
(a)
(b)
(c)
(d)
(e)
(f)
(g)
1
2
3
4
5
6
7
8
9
10
11
12
13
14
15
16
17
18
19
20

PROCESS FOR PRODUCING BIODIESEL WITH REDUCED MONOACYLGLYCEROL CONTENT

CROSS REFERENCE TO RELATED APPLICATION

This application is the National Phase of PCT International Application No. PCT/US2023/023024, filed on May 19, 2023, which claims priority under 35 U.S.C. 119(e) to U.S. Provisional Application No. 63/343,551, filed on May 19, 2022, entitled "NOVEL PROCESS FOR PRODUCING BIODIESEL WITH REDUCED MONOACYLGLYCEROL CONTENT," all of which are hereby expressly incorporated by reference into the present application.

FIELD OF THE INVENTION

The present invention relates to the production of lower alkyl esters of fatty acids to be used as fuel in compression ignition engines and having a reduced monoacylglycerol content. In particular, the novel process is economical and is characterised by minimal usage of expensive pieces of equipment, chemicals and water compared to existing technologies.

BACKGROUND OF THE INVENTION

Biodiesel are fatty acid esters of lower alkyl alcohols, such as but not limited to fatty acid methyl esters (FAME). FAME, which is the most prevalent biodiesel is produced by a transesterification reaction in which triglycerides, such as vegetable or animal oils and fats or blends thereof, are allowed to react with methanol in the presence of a catalyst, preferably an alkaline catalyst and even more preferably sodium methoxide ($NaOCH_3$). This transesterification reaction is nearly complete because one of the reaction products, the glycerol (commonly glycerin or glycerine), is largely insoluble in the FAME and thus can be easily separated from the reaction mixture, for example by decantation, which results in the displacement of the reaction equilibrium towards FAME. Of course, the displacement of the transesterification reaction towards FAME is also favoured by other parameters as well, such as the methanol stoichiometric excess and the catalyst concentration, which catalyst actually reacts as well and is at least partially destroyed in the reaction. However, the species resulting from this destruction still exhibit alkalinity and some catalytical activities. In a recent commentary published by the Wiley Online Library, and freely accessible (https://onlinelibrary.wiley.com/doi/full/10.1002/ejlt.202000188 at the time of the drafting of this specification), A. J. Dijkstra pointed out that the structure of the actual catalytical intermediate is still the object of speculations with arguments in favour of enolate and/or glycerolate anionic species. However, what is clear is that the sodium methoxide is only the precursor of the actual catalyst and that since the actual catalyst is highly polar, it dissolves much more preferentially in the heavy glycerol phase and hence a substantial catalytic activity is lost when the light FAME phase separates from the heavy glycerol phase. Thus, it is probably more correct to state that residual catalytical activity of the catalyst, in any of its forms, is at least partially lost by physical separation and lack of contact with the reactants. Such considerations are consistent with the observation that the transesterification is displaced towards FAME (and glycerol) if a larger quantity of catalyst is used. It is also clear than despite the apparent simplicity of the chemical reactions leading to biodiesel, the exact mechanisms and kinetics are still not fully understood.

Current industrial installations producing FAME by alkaline catalysed transesterification (usually with sodium methoxide) are sized for a given excess of methanol. Usually, they are designed for a methanol stoichiometric excess of 100% and a sodium methoxide catalyst consumption of about 4 kg per ton of converted feedstock (about 0.4%). Those installations are also designed to carry out the transesterification in three steps, each step being ended by a phase separation removing one of the reaction products (the glycerol) in order to shift the reaction towards FAME. In those conditions, about 98% to 99% of the glycerides are converted to yield a crude FAME containing typically, amongst other non-FAME components, monoacylglycerol (MAG) typically in the range of about 0.4% to about 0.8% and diacylglycerol (DAG) and triacylglycerol (TAG), both typically in the range of about 0.1% to about 0.4%, (all percentage being expressed as weight/weight percent unless specified otherwise). State of the art biodiesel facilities produce biodiesel with a MAG content usually close but still exceeding 0.4%. As a matter of fact, there is a wish to minimize the biodiesel' residual partial glycerides (MAG and DAG) in order to maximize the conversion yield in FAME independently of purity specifications.

The crude biodiesel must be washed in order to remove various impurities such as residual catalyst, soaps, glycerol, excess reactant. The standard washing consists in contacting the crude biodiesel with an acid aqueous solution which acidity serves the purpose of neutralizing the residual alkalinity originating from the catalyst and/or its degradation products. However, such acid washing procedure is not able to reduce the concentration of residual MAG.

Consequently, most of the current biodiesel installations are currently producing biodiesel having residual concentration in MAG exceeding the new limits for winter-grade biodiesel set in US (ASTM 6515), which is 0.4% max for winter grade. This new, more stringent limit has been implemented to improve the long-term stability and filtration characteristics of biodiesel such as FAME which is, by far, the most prevalent biodiesel. It is expected that such more stringent specification may be implemented in Europe and other regions of the world as well.

In Asia, future directives will mandate higher blending ratio of biodiesel in petrodiesel (20% and more, i.e., B20). In order to secure trouble free usage of blends containing such high concentration of biodiesel, it is expected that the MAG content of biodiesel should be brought to even lower value such as 0.2% or less, even for usage in mild and hot climates. Therefore, it is expected that, in the future, the tolerable content of MAG in biodiesel will be set at 0.2% max, at least in large markets of the world such as Malaysia and Indonesia.

Several technical solutions are known to reduce the residual concentration of MAG in biodiesel. However, each of them has serious drawbacks.

The residual MAG concentration in the raw biodiesel could be decreased by displacing further the transesterification equilibrium, for example, in the case of FAME, by using a larger excess of methanol or by using more catalyst. However, the preferred catalyst, sodium methoxide, is expensive and in order to keep the production of biodiesel competitive, its amount per unit of converted feed-stock is preferably minimized. Using a higher methanol stoichiometric excess would require resizing the vessels and/or reducing the output of the installation. As the excess methanol is recovered and recycled, this one is actually distilled to obtain a dry methanol. Hence, using large excess of methanol is not wished. Thus, both approaches are not cost effective and/or would require a substantial modification of the already existing biodiesel installations. Even for new installations to be erected, there is a strong incentive to keep the installation as compact as possible and to minimize the catalyst consumption as this one is expensive. Furthermore, this approach is limited in efficiency as it cannot reduce the MAG content of biodiesel to very low level (such as 0.2% or less) because the chemical equilibrium must be respected and imposes a given concentration of reactants and reaction products at the equilibrium. Displacing the equilibrium towards the reaction products to obtain such low concentration of MAG would impose an unrealistic excess of reactants, in particular methanol. Therefore, industrially, post-treatment methods able to reduce the residual MAG present in the crude biodiesel are preferred. Furthermore, the post-treatment should be as economical as possible.

One possible post-treatment is the distillation of the crude biodiesel. This method performs a satisfactory purification of the crude biodiesel but is very costly and induces a substantial yield decrease in the form of a residual pitch. Furthermore, the distillation also removes the natural antioxidants which is not wished since natural antioxidants confer stability to the biodiesel, which is an important characteristic. Therefore, alternative, more cost effective, post-treatment processes have been proposed.

WO2016/098025, discloses a process for the purification of crude biodiesel obtained by reacting triacylglycerol with an alcohol in the presence of a catalyst, comprising a series of water-washing operations in order to reduce the total amount of contaminants and, in particular, sterol glucosides and MAG. The invention is characterised by the addition of water to the reaction mixture before the glycerol phase is separated from said reaction mixture, in order to realise an initial washing of the full reaction mixture. This initial washing includes mixing the reaction mixture with the added water during a sufficient time and separating the aqueous phase (containing impurities) from the biodiesel (for example by decantation). After this initial washing of the full reaction mixture, two successive additional washing steps, in absence of alkalinity, are necessary to reduce sufficiently the residual MAG concentration of the biodiesel.

WO2018210573A1 discloses a method for reducing the content of monoglycerides (MG), in particular saturated monoglycerides (GMG), in a raw biodiesel (RB), which has a monoglyceride (MG) content between 0.4% and 0.7% by weight and a free fatty acid (FFA) content of less or equal 0.25% by weight, characterized by the following steps:

A) provision of the raw biodiesel (RB) with the aforementioned ingredients in the aforementioned concentrations, B) addition (1) of an alkaline-aqueous solution (L) in the form of sodium hydroxide solution to raw biodiesel (RB), the NaOH concentration in the sodium hydroxide solution being less than 4.03 mol/1 and the amount of sodium hydroxide solution added between 1.0 and 3.0% by weight based on the amount of Raw biodiesel (RB) amounts to and wherein the temperature of the raw biodiesel (RB) during the addition of the aqueous-alkaline solution (L) is at least 30° C., C) mixing of the alkaline-aqueous solution (L) with hydrolysis of glycerides in the biodiesel, preferably of monoglycerides (MG), in particular of saturated monoglycerides (GMG), wherein the residence time after the addition of the aqueous-alkaline solution (L) and before the first centrifugal separation (2) is at least 15 minutes, D) first centrifugal separation (2) of a heavy phase (6) comprising the alkaline-aqueous solution (L) with the hydrolyzed ingredients from a light phase (7) comprising the biodiesel by a separator at a speed of 4400 to 7200 rpm, E) drying (5) the light phase (7) and/or (9) to provide a processed biodiesel (AB) for use as fuel with a monoglyceride content of less than 0.4% by weight, the methanol content in the biodiesel in steps AE is less than 0.7% by weight based on the total weight of raw biodiesel (RB) used or processed biodiesel (AB) in the respective step.

Thus, washing methods able to reduce MAG content of crude biodiesel are available. However, those methods involve substantial water amount in order to realize three successive washing steps or substantial chemical usage in the form of diluted alkaline washing solutions and the use of several expensive centrifuge separators. Furthermore, in the process disclosed by WO2018210573A1, the methanol (MeOH) content of the crude biodiesel must be less than 0.7%, preferably less than 0.2%, and particularly preferably less than 0.05% by weight based on the total weight of crude biodiesel. Such mandatory low content of methanol in the crude biodiesel can induce a reverse reaction decreasing the yield by reverse transesterification especially when the crude biodiesel still contains active catalyst and/or is contacted with strong alkali that may act as catalyst. Thus, this requirement is particularly potentially damageable, and it would be advantageous to design a new and inventive post-treatment process still efficient even if the residual methanol content in the crude biodiesel subjected to the post-treatment is substantially higher in order to prevent the reverse transesterification of the post-treated crude biodiesel when this one still contains active catalyst.

OBJECT OF THE INVENTION

It is an object of the invention to overcome the various disadvantages and shortcomings of the prior art processes for the post-treatment of crude biodiesel aiming at the reduction of its residual MAG content. In particular, a process for the post-treatment of crude biodiesel able to reduce the MAG residual content of said crude biodiesel to a concentration lower than 0.4% and even preferably to a concentration lower than 0.2% and requiring the usage of less water and less chemical than known processes is specifically desired. The innovative process should not induce substantial saponification of the biodiesel. Optionally, the innovative process should induce the conversion of at least a fraction of the residual MAG into biodiesel which would thus increase the conversion rate of the feedstock.

ADVANTAGES OF THE INVENTION

It is an advantage of the present invention to disclose a process for the post-treatment of crude biodiesel able to reduce the MAG residual content of said crude biodiesel to a concentration lower than 0.4% and even preferably to a concentration lower than 0.2%.

It is an additional advantage of the present invention to disclose a process for the post-treatment of crude biodiesel able to reduce the use of chemicals in particular the use of alkali such as sodium hydroxide, and acid such as citric acid or phosphorous acid compared to known processes, while the reduction of the MAG residual concentration from the post-treated crude biodiesel still remains substantial.

It is an additional advantage of the present invention to disclose a process for the post-treatment of crude biodiesel able to reduce the usage of water by realizing two washing steps counter-currently with only one volume of fresh acid water (used for the second washing step), which is recycled and used for the first washing step.

It is an additional advantage of the present invention to disclose a process for the post-treatment of crude biodiesel able to be implemented into existing biodiesel installations without any major modifications and without substantial investment.

It is an additional advantage of the present invention to disclose a process for the post-treatment of crude biodiesel able to prevent the saponification of the crude biodiesel during said post-treatment.

It is an additional advantage of the present invention to disclose a process for the post-treatment of crude biodiesel able to optionally convert a fraction of the residual MAG contained in said crude biodiesel into biodiesel.

It is an additional advantage of the present invention to disclose a process for the post-treatment of crude biodiesel able to improve its long-term stability and filtration characteristics. Indeed, reducing the MAG residual content of biodiesel is a prerequisite for its long-term stability and filtration characteristics, in particular for fuels used at low temperature and/or resulting from high blending ratios (such as 20% or more of biodiesel into petrodiesel, i.e., B20).

It is an additional advantage of the process for the post-treatment of crude biodiesel, according to the present invention, to be efficient even if the crude biodiesel contains substantial amount (i.e., higher than 1%) of monohydric lower alkyl alcohol, such as for example MeOH, in order to preclude any reverse transesterification.

These and other advantages will become apparent from the description of the process according to the present invention and the examples.

SUMMARY OF THE INVENTION

The following presents a summary of this disclosure to provide a basic understanding of some aspects. This summary is intended to neither identify key or critical elements nor define any limitations of embodiments or claims. This summary may provide a simplified overview of some aspects that may be described in greater detail in other portions of this disclosure. Furthermore, any of the described aspects may be isolated or combined with other described aspects without limitation to the same effect as if they had been described separately and in every possible combination explicitly.

It has surprisingly been found that the above object can be attained with a post-treatment process of crude biodiesel containing residual MAG and comprising the steps of:

(a) providing a crude biodiesel, (b) contacting said crude biodiesel with a concentrated alkaline solution, and agitating the resulting mixture, to obtain a concentrated alkaline treated biodiesel, (c) contacting said concentrated alkaline treated biodiesel of step (b) with a recycled water and agitating the resulting mixture to obtain a first agitated mixture, (d) phase separating said first agitated mixture resulting from step (c) to obtain a pre-washed biodiesel and a spent water phase, (e) contacting said pre-washed biodiesel of step (d) with fresh acidic water and agitating the resulting mixture to obtain a second agitated mixture, (f) phase separating said second agitated mixture of step (e) to obtain a water phase which is recycled in step (c) as said recycled water, and a fully washed biodiesel, (g) drying said fully washed biodiesel of step (f) to obtain a purified biodiesel, wherein, the concentrated alkaline solution used in step b) is at least 5 mol/L and its volume is max 1% of the volume of said crude biodiesel, and wherein the residual concentration in MAG of the purified biodiesel does not exceed 0.4%, even preferably 0.2%.

In another embodiment, the crude biodiesel from step (a) is FAME and results from the transesterification of a fatty material with methanol, said transesterification being catalysed by an alkaline catalyst such as sodium methoxide.

In another embodiment, the crude biodiesel from step (a) is FAME and results from the transesterification of a fatty material with methanol, said transesterification being catalysed by an alkaline catalyst and still contains 1% to 4% of residual methanol.

In another embodiment, the crude biodiesel from step (a) is FAME and results from the transesterification of a fatty material with methanol, said transesterification being catalysed by an alkaline catalyst and said transesterification being further realised in several steps, each step being ended by a phase separation of a light crude FAME phase and a heavy glycerol phase.

In another embodiment, the crude biodiesel from step (a) is FAME and results from the transesterification of a fatty material with methanol, said transesterification being catalysed by an alkaline catalyst and said transesterification being further realised in several steps, each step being ended by a phase separation of a light crude FAME phase and a heavy glycerol phase, and the final light crude FAME does not contain more than 0.5% of residual glycerol but more than 0.4% of MAG.

In another embodiment, the mixture of step (b) resulting from the contact of the crude biodiesel with a concentrated alkaline solution is agitated with a high-shear mixing device, under vigorous to violent agitation intensity during a period ranging from 0.1 minute to 5 minutes.

In another embodiment, the mixture of step (b) resulting from the contact of the crude biodiesel with a concentrated alkaline solution is agitated in a cavitation reactor, said agitation being maintained during a period ranging from 0.01 minute to 0.1 minute.

In another embodiment, the first and/or second agitated mixture(s) of step (c) and/or step (e) is/are agitated under mild to moderate intensity for a period ranging from 1 minute to 60 minutes.

In another embodiment, the reduction of MAG provided by the above disclosed process is achieved through saponification with an alkali transforming said MAG into soap, and/or through transesterification with a monohydric lower alkyl alcohol transforming said MAG into biodiesel.

In another embodiment, the above disclosed process is continuous and the concentrated alkali solution of step b) is contacted in line to the crude biodiesel with the use of a metering pump.

In another embodiment, the purified biodiesel resulting from the above disclosed process, has a MAG content lower than 0.4%.

In another embodiment, the purified biodiesel resulting from the above disclosed process, has a MAG content lower than 0.2%.

In another embodiment, the purified biodiesel resulting from the above disclosed process, enters into blends containing petrodiesel and 10% or more of said purified biodiesel, such as for example blends known as B10, B20, B30, B40, B50, B60, B70, B80 or B90 and containing respectively 10%, 20%, 30%, 40%, 50%, 60%, 70%, 80% or 90% of purified biodiesel.

The following description and the drawings disclose various illustrative aspects. Some improvements and novel aspects may be expressly identified, while others may be apparent from the description and drawings.

BRIEF DESCRIPTION OF THE FIGURES

The accompanying drawings illustrate various systems, apparatuses, devices and methods, in which like reference characters refer to like parts throughout, and in which:

FIG. 1 represents schematically a process for the post-treatment of crude biodiesel according to an embodiment of the present invention.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DETAILED DESCRIPTION OF THE INVENTION

Reference will now be made to exemplary embodiments, examples of which are illustrated in the accompanying drawings. It is to be understood that other embodiments may be utilized and structural and functional changes may be made. Moreover, features of the various embodiments may be combined or altered. As such, the following description is presented by way of illustration only and should not limit in any way the various alternatives and modifications that may be made to the illustrated embodiments. In this disclosure, numerous specific details provide a thorough understanding of the subject disclosure. It should be understood that aspects of this disclosure may be practiced with other embodiments not necessarily including all aspects described herein, etc.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Step (a) of the process according to the present invention consists in providing a crude biodiesel. Usually, the crude biodiesel results from a transesterification reaction wherein a fatty mixture comprising fatty acid glycerol esters and a monohydric lower alkyl alcohol are allowed to react in the presence of an alkaline transesterification catalyst to produce a mixture comprising, as main components, fatty acid lower alkyl esters and glycerol.

In the context of the present invention, this monohydric lower alkyl alcohol is defined as a $C_1$-$C_4$ alcohol selected from the group of methanol, ethanol, propanol, isopropanol and butanol. Preferably, the monohydric lower alkyl alcohol is methanol and therefore the fatty acid lower alkyl esters is referred to as FAME which is by far the most prevalent currently produced biodiesel. As a matter of fact, when the term "alcohol" will be used it will be referred to monohydric lower alkyl alcohol.

In this description, the term "processed biodiesel" will designate a partially post-treated crude biodiesel at any stage of the process according to the present invention, and the term biodiesel includes FAME.

However, the present invention is not limited to FAME or to biodiesel resulting from transesterification catalysed by an alkaline catalyst. Crude biodiesel resulting from a transesterification catalysed by an acid catalyst, or an enzymatic catalyst may be a valid starting material for the process according to the present invention, since even if those transesterification reactions are displaced favourably, they are still not fully complete and thus residual MAG remains in the reaction products.

However, in most instances, the crude biodiesel that will be post-treated by the present invention will results from the transesterification of a fatty material with methanol catalysed by sodium methoxide, said transesterification being realised in several steps, each step being ended by a phase separation yielding to a light crude FAME phase and a heavy glycerol phase.

Preferably, the crude biodiesel in step (a) of the present process contains no more than 1%, even more preferably no more than 0.5% of glycerol.

Preferably, the crude biodiesel in step (a) still contains 1 to 4% of monohydric lower alkyl alcohol such as for example methanol. This is advantageous to limit the reverse transesterification reaction during the subsequent steps of the process according to the present invention and the substantial presence monohydric lower alkyl alcohol such as MeOH may lead to the conversion of the MAG contained in the crude biodiesel into FAME when said crude biodiesel is contacted with a concentrated solution of alkali. It is believed that the concentrated solution of alkali may also acts as esterification catalyst, especially under intense mixing, and particularly when the MAG concentration of the crude biodiesel is higher than about 0.4%. If the MAG concentration of the crude biodiesel is already close to, or lower than 0.4%, the addition of a concentrated solution of alkali leads mostly to the saponification of those MAG. However, it is observed that no substantial saponification of FAME has been observed when MeOH is present in the crude biodiesel. Thus, surprisingly, it has been observed that the presence of a minimal amount of MeOH (such as for example 2%) in the crude biodiesel allows to saponify selectively MAG, which are minor components in the crude biodiesel (less than 1%) while FAME, which is the most abundant component in the crude biodiesel, is not saponified even though both components contain ester function. As a matter of fact, this surprising observation could be related to the fact that in a MAG molecule, the presence of two hydroxyl functions could act as co-catalyst during the saponification and/or esterification. However, to our knowledge, such effect has never been demonstrated in the case of residual MAG present in crude biodiesel and therefore this explanation remains purely speculative.

Thus, the preferred crude biodiesel of step (a) in FAME and results from a transesterification reaction catalysed with alkaline catalyst such as sodium methoxide (also referred to as sodium methanolate or sodium methylate). It can be added as such or as a solution in a lower alkyl alcohol. It is commercially available as a 30% solution in methanol. In industrial installations, about 4 Kg of sodium methoxide per ton of the fatty mixture is expected to be sufficient. As a matter of fact, the catalyst being expensive, there is a constant attention in the field to limit its usage as much as possible. This includes high quality starting materials (with low water, contaminants and FFA contents) as well as realising the transesterification reaction in multiple stages each separated by a phase separation, with fresh methanol and catalyst being added for each of these steps.

Indeed, the transesterification is preferably carried out in stages that are separated from each other by removal of glycerol (usually by decantation) followed with the addition of a fresh solution of catalyst and methanol. Thus, if several stages are involved, the FAME obtained after the separation of the heavy glycerol phase liberated by the transesterification during the last stage constitutes the preferred starting crude biodiesel provided in step (a) of the process according to the present invention.

Optionally, the heavy glycerol phase obtained after the last stage is used as a pre-treatment of the fatty mixture feed-stock selected to produce the FAME. Alternatively, one or more of the heavy glycerol phases obtained after the individual transesterification stages are used as pre-treatment of the fatty mixture feed-stock. Indeed, this or those heavy glycerol phase(s) still contain(s) active catalyst and some methanol. Therefore, such recycling is useful to neutralize FFA possibly present in the feed-stock and already initiates the transesterification reaction. Thus, such recycling saves on the catalyst and consequently reduces the chemicals needed to neutralize the residual catalyst.

Alternatively, the provided crude biodiesel results from a transesterification reaction catalysed by an acid catalyst such as sulfuric acid, sulfonic acid, or solid acid catalysts (such as alumina-silicates and/or zeolites). Alternatively, the provided crude biodiesel results from a transesterification reaction catalysed by one or more enzymes usually belonging to the lipase family. However, after the one or more reaction step(s) per se, at least one final settling and phase separation of the reaction mixture will take place to remove most of the glycerol from the final reaction mixture in order to provide a useful crude biodiesel. Since the conversion is not total with acid and/or with enzymatic catalyst, the resulting crude biodiesel also contains substantial amount of MAG and will thus benefit of the process according to the present invention.

Crude biodiesel usually contains some active catalyst species, part of the excess alcohol (such as methanol in the case of FAME), some glycerol that may remain soluble and most of the minor constituents that were present in the raw material such as tocopherol. It will contain also typically a substantial quantity of MAG, typically about 0.4% to about 0.8%. The variation in MAG content of the crude biodiesel, for given production parameters, may be due to variation of feedstock quality but is mostly correlated to the transesterification completion: in general, the more this transesterification is complete, the lower will be the residual MAG concentration.

Optionally, the crude biodiesel provided in step (a) of the present process is FAME and the residual methanol contained in said crude biodiesel may be partially evaporated prior to step (a). Care should be taken to not reverse the transesterification reaction during the methanol evaporation since, at this stage, active catalyst species are still present in the crude biodiesel. Therefore, this optional step is usually realised under moderate vacuum to remove about 50% of the methanol content. The resulting flashed crude biodiesel contains a few percent of methanol, typically 1% to 6%, preferably about 1.5% to 4%. However, the process according to the present invention remains advantageous without this optional methanol evaporation step removing a part of said methanol from the crude biodiesel. As a matter of fact, another advantage of this partial methanol removal is to provide a dry methanol stream that can be recycled upstream. Actually, in most instances, this is the justification of this methanol evaporation step. If the partial flash evaporation is not performed at this stage, the residual methanol will become contaminated with water and therefore its recovery in a dry form will be more energy demanding.

Optionally, the crude biodiesel provided in step (a) of the present process is FAME and may have been already subjected to standard purification procedure(s) and therefore may conform to old quality norms and thus may still contain up to 0.7% of MAG. Such biodiesel may also be considered as valid starting material of the present process and be considered as crude biodiesel in the context of the present invention. However, such biodiesel has reduced methanol content (max 0.2%) and no residual catalyst. For this type of starting material, it is advantageous to add some methanol prior to proceeding to the step (b) of the process according to the present invention. Indeed, the adjunction of methanol will prevent the saponification of the FAME and may favour the conversion of MAG into FAME when a concentrated solution of alkali is contacted to such crude biodiesel. Alternatively, the concentrated solution of alkali contains methanol as well. Indeed, even if no catalyst residue is present in such biodiesel, a reverse reaction is still possible due to the addition of the concentrated solution of strong alkali to said crude biodiesel.

It has most surprisingly been observed that the concentration of the residual MAG present in the crude biodiesel is more efficiently reduced when the crude biodiesel is contacted with a small volume of a concentrated solution of alkali than when the same crude biodiesel is contacted with a larger volume of a diluted solution of alkali, even if the absolute quantity of alkali is identical in both cases. Thus, it has been thus surprisingly observed that a concentrated solution of alkali is more efficient to reduce the concentration of residual MAG in a crude biodiesel than a diluted solution of alkali even though, globally, the same quantity of alkali is used per ton of crude biodiesel. This surprising observation leads to an efficient reduction of MAG contained in crude biodiesel with substantially less chemical, in particular less alkali. Since less alkali is used, less acid is subsequently needed to neutralise the residual alkali present in the processed crude biodiesel. Furthermore, the use of a concentrated form of alkali solution makes possible to perform two washing steps counter currently with only one volume of fresh acidic water (used for the second washing) which is recycled to perform a first washing, and thus the process according to the present invention requires considerably less washing water per ton of processed crude biodiesel compared to known processes. The details of this surprising observation are disclosed in the examples and particularly the examples 2a, 2b and 2c.

Thus, in the process according to the present invention, step (b) consists in contacting said crude biodiesel with a small volume of concentrated alkaline solution, and agitating the resulting mixture intensively, to obtain an alkaline treated crude biodiesel. Preferably, the alkaline solution is an aqueous solution. Alternatively, the alkali may be dissolved or dispersed in a low alkyl alcohol such as methanol or ethanol. However, even in that case, some water must be present to support the dissociation of the alkali and generates hydroxyl anions. Preferably, the concentrated alkaline solution used in step b) is at least 5 mol/L and its volume does not exceed 1%, preferably 0.5% of the volume of the treated crude biodiesel. Even more preferably, the volume of the concentrated alkaline solution used in step b) ranges from about 0.4% to about 0.1% of the volume of the treated crude biodiesel. Preferably, in continuous industrial installations, this small volume of concentrated alkaline solution is added in-line to the crude biodiesel with the use of a metering pump. Preferably, the agitation of the resulting mixture is realised in a high-shear mixer or with a cavitation reactor. Both pieces of equipment are known in the field and are often used in the field of biodiesel and edible oil refining. Those conditions are sufficient to reduce the concentration of MAG present in the crude biodiesel by about 50% or more while using a reduced amount of alkali in comparison to known process using diluted alkali solution contacted to the crude biodiesel.

As a matter of fact, the small volume of the contacted concentrated alkali solution may favour the formation of small droplets when intensively agitated with the crude biodiesel because the coalescence of the droplets (during the intense mixing) is nearly non-existing for such small fraction of a dispersed phase. Thus, even if this is counter-intuitive, a greater contact between the crude biodiesel and the concentrated alkali solution could be obtained when a small volume of a concentrated alkali solution is dispersed in said crude biodiesel and, surprisingly, induces a higher reduction of MAG.

Indeed, the process according to the present invention is able the reduce the concentration of MAG from about typically values ranging from about 0.4% to about 0.8% to values ranging from about 0.4% to about 0.2 or even lower with a minimal amount of alkali such as for example about 1000 ppm of NaOH per ton of crude biodiesel treated. In comparison, if a more diluted alkali solution is used, 1500 ppm of NaOH per ton of crude biodiesel is required to reduce similarly the MAG of crude biodiesel. The details of this observation are disclosed in the examples and particularly the examples 3a and 3b. Of course, the quantity of alkali to be used will depend on the exact residual MAG concentration of the crude biodiesel and on the targeted value of residual MAG in the purified biodiesel.

The present invention focuses on the reduction of MAG but may have supplementary benefits, notably the reduction of sterol glucosides.

Even if this observation is totally unexpected and currently not fully understood, it is believed that contacting the crude biodiesel with a concentrated alkaline solution will enhance the saponification of MAG and may induce the conversion of some MAG in FAME since substantial amounts of methanol are still present in the crude biodiesel and in those conditions, the concentrated alkali may act as a transesterification catalyst. Therefore, such mechanism may also have a moderate impact on the yield of the transesterification reaction of the processed biodiesel. It is believed that such conversion into FAME is less probable if a more diluted alkaline solution is contacted with the crude biodiesel. However, it is believed that conversion of MAG into FAME only takes place when the residual concentration of MAG in the crude biodiesel exceeds about 0.4%. Indeed, when the concentration of MAG is the crude biodiesel is already moderate (about 0.45%), it has been shown that the reduction of MAG induced by the process according to the present invention corresponds to a similar consumption of the alkali (on a molar basis). Consequently, it can be inferred that all removed MAG have been saponified and that no FAME saponification did occur. When the concentration of MAG in the crude biodiesel is more significant (about 0.85%), it has been shown that the reduction of MAG induced by the process according to the present invention is much more important when the crude biodiesel contains 2% of methanol than when a very low amount of methanol is present (0.05%). It can be inferred that when methanol is present in significant amount, in addition of the MAG saponification reaction, induced by the concentrated alkali solution, a transesterification (with methanol) takes place converting thus a least a fraction of the residual MAG into FAME. It is believed that the transesterification with methanol is only possible when the crude biodiesel contains a more significant amount of residual MAG due to the transesterification chemical equilibrium constant that must be respected. Unfortunately, theoretical data are lacking to confirm this hypothesis. The surprising observations leading to this hypothesis are shown in examples 2 and 4.

The agitation during step b) is preferably intense. Intense agitation will favour a fine dispersion of the droplets of the concentrated alkali solution in the crude biodiesel which in turn will favour intense contacts and enhances chemical reactions and/or diffusions and exchanges between the phases. This is achieved with intense mixing characterized as "vigorous" to "violent" in the mix scale (or scale of agitation) discussed hereafter. The mix scale is used to quantify the agitation intensity in a given process. Characterizing the agitation is complex because its calculation relies on viscosities, interfacial tension, densities, shear forces and furthermore various models have been proposed. In the industry, a more pragmatic and empirical approach has been proposed to characterize the agitation, in particular for mixing devices. This scale has been proposed by a mixing devices manufacturer (Dispersetech, US). The mix scale is a 1-to-10 agitation scale based on the impeller pumping capacity divided by the tank cross-sectional area, resulting in a bulk fluid velocity. This velocity, in feet/minute (ft/min.), is divided by 6 to obtain an arbitrary scale of agitation. This simple 1-to-10 scale has been used as a valuable tool for describing mixing intensity. In the mix scale, values from 1 to 3 corresponds to mild mixing, values from 4 to 6 corresponds to moderate mixing, values from 7 to 8 correspond to vigorous mixing and values from 9 to 10 correspond to violent mixing. Visually, vigorous mixing generates some splash with boiling event at the liquid surface and occasional vortex. Violent mixing generates constant splashing, large wave formations and erratic vortex.

It is understood that agitation includes mixing (such as provided by mixing devices) and also include cavitation (such as provided by hydrodynamic cavitation reactors). In this description, mild to moderate mixing/agitation are collectively named medium mixing/agitation, and vigorous to violent mixing are collectively named intense mixing/agitation.

As a matter of fact, a convenient procedure for starting the process according to the present invention is to set a mixing intensity of step (b) to about 6 according to the mix scale, evaluate its effect on the MAG reduction and eventually adjust the mixing intensity as needed. Alternatively, if the mixing device used in step (b) provides a very narrow range in the mix scale and/or its nominal mixing capacity is limited in the "vigorous" range, the concentration of alkali can be increased in order to obtain the needed reduction of MAG. Such mixing tanks and devices, able to provide the suitable mixing intensity as needed in the process according to the present invention are widely used in a variety of industries and available from several manufacturers as standard equipment.

Alternatively, the agitation of the mixture obtained in step (b) of the process according to the present invention can be realised in a cavitation reactor, preferably a hydrodynamic cavitation reactor. A hydrodynamic cavitation reactor is able to intensively mix fluids without using impeller. Rather, the mixing is created upon localized acceleration/deceleration of the fluids inducing locally extremely high and low pressures creating cavities in the fluid which, upon collapse, generate high energy release resulting in intense mixing (amongst other effects). The advantages of cavitation reactors are their small size, low residence time and reliability due to the absence of moving parts. On the other hand, they require a substantial initial investment and usually a high-capacity pump is needed to feed the fluid to the cavitation reactor at the proper velocity and pressure. However, cavitation reactors usually allow the completion of chemical reactions with less reactant as for example in the degumming and/or neutralisation of edible oil where cavitation reactors are strongly established, particularly for the degumming and/or neutralisation of soybean oil. The same reduction in chemicals needed for the reduction of MAG in the crude biodiesel may be anticipated (up to 50% of reduction). Amongst hydrodynamic cavitation reactors, a relatively new category is known as "low-pressure cavitation reactors" and are able to generate sufficient cavitation at low hydrodynamic velocities and pressures, and thus do not require high capacity feeding pump. Furthermore, they are usually less expensive. Those "low-pressure cavitation reactors" are thus particularly preferred as more economical. Cavitation reactors (including high pressure hydrodynamic cavitation reactors and low pressure hydrodynamic cavitation reactors) are supplied for example by Cavitation Technology Inc (US).

Furthermore, the process according to the present invention makes possible the recycling of the fresh acidic water that is used for the second (and last) washing of the pre-washed biodiesel. The acidy of this fresh acidic water serves the purpose of the inactivation of any alkalinity still present in the pre-washed biodiesel. The second and last washing step of the pre-washed biodiesel, in step (e) of the process according to the present invention, is typically performed with fresh acidic water containing about 0.15% to about 0.5% of citric acid. The acid must be in slight excess compared to the total alkalinity of the processed biodiesel, in particular the alkalinity contained in the pre-washed biodiesel in order to secure a complete inactivation of the residual catalytical activity in particular the alkaline anions. Therefore, the water phase recovered by phase separation, in step (f) after the second and last washing will still be slightly acid but closer to neutrality since part of the acid will be neutralised. This recovered water phase is named "recycled water". Thus, in the process according to present invention, this recycled water is used again and contacted to the concentrated alkali treated biodiesel resulting from step (b). Therefore, since the concentrated alkali is added to the crude biodiesel in an independent step, all the added alkali will be available to react with the MAG before the addition of this still slightly acid recycled water. Therefore, the process according to the present invention reduce substantially the needed chemicals, in particular the alkali, and also substantially reduce the needed water to wash the crude biodiesel, since the same water is used twice counter-currently.

Thus, in step (c) of the process according to the present invention, the recycled water is contacted to the concentrate alkaline treated biodiesel obtained from step (b). The contacting is preferably realised in a mixing tank of large capacity allowing a retention time from about 1 minute to about 60 minutes, preferably from about 10 minutes to about 30 minutes. Typically, the volume of the recycled water represents about 3% to about 6% of the concentrated alkali treated biodiesel obtained from step (b). Step (c) is preferably realised under medium agitation corresponding to the "mild" to "moderate" agitation in the mix scale discussed above. Medium agitation will favour the coalescence of the very small droplets that have been created during step (b). Indeed, those droplets are so small than operating a phase separation on such a mixture may potentially be difficult and inefficient. On the contrary it has been observed that a long maturation under medium agitation of this first mixture (which results from contacting the concentrated alkali treated biodiesel from step (b) to the recycled water obtained from step (f) produces a coarser mixture easy to separate by conventional phase separation techniques such as decanter, settler, centrifuge or other common liquid/liquid phase separations devices. Furthermore, the addition of the recycled water, which is still slightly acid already contributes to the neutralisation of the residual alkalinity present in the concentrated alkali treated biodiesel obtained from step (b). The residual slight acidity of the recycled water comes from the fact that said recycled water originates from the final washing and neutralization, step (e) of the process according to the present invention, and, in step (e), fresh acidic water is contacted with the pre-washed biodiesel in order to deactivate any alkalinity present in said pre-washed biodiesel. Since the fresh acidic water contains on purpose a stoichiometric excess of acid to ensure a complete neutralisation of the alkalinity during the last washing step, the remaining recycled water is still slightly acid. In addition, the long contact time between the recycled water and the concentrated alkaline treated biodiesel from step b) favours the diffusion of any polar components present in the processed biodiesel towards the aqueous phase. The medium mixing occurring in step (c) favours the obtention of non-emulsified mixture easy to phase separate. This phase separation is realised in step (d) of the process according to the present invention and can be performed with a variety of methods and devices known in the field such as decanters, settlers, and centrifuge separators. The phase separation operated in step (d) yields spent water which is discarded and pre-washed biodiesel which is further processed.

In the process according to the present invention, step (e), the final and full inactivation of the catalytic intermediates and/or any residual alkalinity, is performed on the pre-washed biodiesel resulting from the phase separation operated in step (d). This is realised by contacting a fresh acidified water to the pre-washed biodiesel and maintaining a sufficient agitation time of about 1 minute to about 60 minutes, preferably from about 10 minutes to about 30 minutes. The agitation is preferably medium, corresponding to mild to moderate in the mix scale discussed previously, to again allow a maturation and diffusion between the phases. Emulsion should be avoided to not jeopardise the downstream phase separation.

The type of acid has been found not to be critical provided it is sufficiently strong to inactivate the catalytic intermediates present in the pre-washed biodiesel. Citric acid has been found to be effective but other acids such as but not limited to phosphoric acid can be used as well in the process according to the present invention. The amount of acid to be used is preferably in stoichiometric excess to the residual alkalinity still present in the pre-washed biodiesel obtained from step (d). The molar alkali concentration can be determined by titration. Using large excess of acid constitutes an unnecessary expense that should be avoided. Usually, a stoichiometric excess of about 5% to about 50% is satisfactory. Alternatively, the acid may firstly be added to the pre-washed biodiesel in the form of a concentrated solution which is mixed intensively during a short time such as for example 1 minute. After this initial intense mixing, the mixture is transferred to a conventional tank containing fresh water and the resulting new, more diluted mixture is agitated under medium intensity during a longer period, typically during about 1 minute to about 60 minutes, preferably from about 10 minutes to about 30 minutes. In a batch process, a standard agitator will be fully adequate to disperse the acidified water solution into the processed biodiesel. In a continuous system, a simple mixing device such as for instance a static mixer has been found to be satisfactory provided the acidified aqueous solution is metered sufficiently accurately into the processed biodiesel stream. In case of fluctuations, the amount of acid must be increased so that its minima are still in excess of the stoichiometric requirements.

The temperature during step (e) is not critical. Accordingly, step (e) is preferably carried out at the same temperature than the temperature of steps (a) to (d) of the process according to the present invention. However, since step (g), the drying of the processed biodiesel, may be carried out at a higher temperature which implies a heating stage, the pre-washed biodiesel of step (d) may be heated to about 90° C. before the addition of the fresh acidic water. In that case, the temperature of the fresh acidic water will be about 90° C. as well.

The final phase separation of the process according to the present invention is realised in step (f) and can be performed with a variety of methods and devices known in the field such as decanters, settlers, and centrifuge separators. Thus, this phase separation yields a recycled water which is still slightly acid and a fully washed and neutralised biodiesel. The recycled water is recycled upstream, in step (c), of the process according to the present invention and the fully washed and neutralised biodiesel only needs to be dried, in step (g), to comply to international quality norms.

In step (g) of the process according to the present invention, the water content and possibly the methanol content of the fully washed and neutralised biodiesel of step (f) are lowered to respectively at least 0.05% and 0.2% by evaporation under reduced pressure. The purified biodiesel resulting from step (g) conforms to the most recent quality norms in particular to ASTM D6751-15ce requiring MAG lower than 0.4%. Such drying step is systematically realised in biodiesel production facilities and therefore the skilled artisan does not need further details in order to adequately accomplish step (g).

FIG. 1 represents schematically the process according to the present invention. However, FIG. 1 must not be construed as a limitation of the process according to the present invention. FIG. 1 is only one of the possible embodiments of an installation for the post-treatment of crude biodiesel, in particular for the reduction of MAG contained in said crude biodiesel, taking advantage of the process according to the present invention. The invention will be defined and only limited by the claims.

As illustrated in FIG. 1, crude biodiesel (1) is continuously provided and can originate from a variety of transesterification technologies. This crude biodiesel typically contains MAG in concentration ranging from about 0.4% to about 0.8%. This crude biodiesel is contacted with a concentrated solution of alkali which is stored in a holding tank (2). Typically, the concentrated solution of alkali is introduced in-line (3) into the crude biodiesel and precisely dosed by a metering pump (4). The crude biodiesel, contacted with the small quantity of alkali is introduced in a high-shear mixer (5) and intensively mixed. The high-shear mixer is sized to allow a residence time of about one minute. Alternatively, the high-shear mixer can be replaced by a cavitation reactor, in particular a low-pressure cavitation reactor with a pump up-stream of said low-pressure cavitation reactor in order to convey sufficient hydrodynamic velocity to the mixture made of crude-biodiesel and concentrated solution of alkali. In the latter case, the holding time will range from less than 1 second to a few seconds. After this intense agitation, the concentrated alkaline treated biodiesel is conducted (6) to a large holding tank (7) and contacted with recycled water (8). Typically, the holding tank (7) is sized to allow a residence time of about 1 minute to about 60 minutes, preferably under medium agitation. During this maturation, the polar components contained in the concentrated alkaline treated biodiesel will migrate in the water phase and, simultaneously, the coalescence of the finely dispersed concentrated alkali solution into a coarser dispersion easier to separate will occur. Then, the mixture is conducted (9) to a phase separation device (10) where said mixture is separated into a spent water containing most of the impurities that were present in the crude biodiesel and a pre-washed biodiesel. The spent water (11) is conducted to a suitable treatment unit for wastewater, such as a biodigestor for example (not shown). The processing of this wastewater is highly dependent on local regulations and circumstances. The pre-washed biodiesel (12) is conducted to a second holding tank (13) and is contacted with fresh acidic water (14). The mixture made of the pre-washed biodiesel and the fresh acidic water is agitated moderately during about 1 minute to about 60 minutes. In this step, all the remaining alkaline components derived from the catalyst and/or from the concentrated alkali solution still present in the pre-washed biodiesel are neutralised and removed. Alternatively, the acid can be introduced in-line in the form of a concentrated acid solution and the resulting mixture intensively agitated in a high shear mixer having a residence time of about one minute for example. Then, pure water may be added to this intensively agitated mixture. As a matter of fact, the mode of addition of the acid is not critical since the MAG reduction occurs previously when the concentrated alkaline solution is contacted to the crude biodiesel. Then, this mixture that has been agitated in (13) is conducted (15) to a second phase separation device (16) where said mixture is separated into the fully washed biodiesel (17) and the recycled water (8) which is indeed recycled to perform the first washing step. The fully washed biodiesel is then sufficiently purified and will be further dried (18) with known processes at low pressure and high temperature. After this drying step that removes low molecular contaminants (19) such as water and any remaining lower alkyl alcohol (usually methanol) and other remaining volatile component(s) that may be present, the final purified biodiesel (20) meeting the specifications for commercialization is stored. Various phase separation devices such as decanter, or centrifuge separator can be used and are known in the field. Usually, phase separation is not an issue provided soaps concentration is minimized to less than 0.05%. This is also known in the field and is achieved by reducing the quantity of free fatty acid present in the feedstock, particularly when the transesterification is catalysed by sodium methoxide and/or sodium hydroxide. In FIG. 1, the steps (a), (b), (c), (d), (e), (f) and (g) of the process according to the present invention have been represented to illustrate the localisation of those various steps.

Examples

Crude Biodiesel Synthesis

Different batches of crude biodiesel have been synthetised with laboratory equipment and vessels but with a procedure mimicking a typical industrial process producing crude FAME. The feedstock was refined, bleached, and deodorized (RBD) palm oil, the alcohol was methanol, and the catalyst was a 30% solution of sodium methoxide in methanol. Table 1 reports the properties of said RBD palm oil feedstock supplied by a major international palm oil processor. The properties of this RBD palm oil are typical of a good quality feedstock that would be used in a premium industrial biodiesel production facility. Key parameters are low FFA (less than 0.05%), low total insoluble impurities (less than 100 ppm), low moisture content (less than 100 ppm) and P content which needs to be lower than 10-15 ppm.

TABLE 1

Feedstock specifications (commercial RBD palm oil)

| Main Contaminations | Value |
|---|---|
| FFA (% as C16:0) | 0.04 |
| Moisture content by KF (ppm) | 54.2 |
| Insoluble impurities (ppm) | 59 |
| Soaps (ppm as Na-C16:0) | 7.2 |
| Elements via ICP (ppm) | |
| P | 2.6 |
| Ca | 1.9 |
| Mg | 0.83 |
| Na | 0.95 |
| K | 1.0 |
| Fe | 0.68 |
| Composition by GC (%) | |
| Glycerol | 0.002 |
| FFA | 0.05 |
| FAME | 0.09 |
| Monoglycerides (MAG) | 0.03 |
| Squalene | 0.01 |
| Diglycerides (DAG) | 5.8 |
| Triglycerides (TAG) | 93.9 |
| Unsaponifiables | 0.12 |
| Fatty acid composition (% by GC) | |
| C12:0 | 0.11 |
| C14:0 | 0.88 |
| C16:0 | 43.21 |
| C16:1c | 0.12 |
| C17:1 | 0.11 |

TABLE 1-continued

Feedstock specifications (commercial RBD palm oil)

| Main Contaminations | Value |
|---|---|
| C17:2 | 0.03 |
| C18:0 | 4.65 |
| C18:1c | 40.46 |

TABLE 1-continued

Feedstock specifications (commercial RBD palm oil)

| Main Contaminations | Value |
|---|---|
| C18:2c | 9.92 |
| C18:3c | 0.18 |
| C20:0 | 0.26 |
| C20:1c | 0.08 |
| SFA (%) | 49.11 |
| MUFA (%) | 40.77 |
| PUFA (%) | 10.09 |
| Trans FA (%) | 0 |
| IV calculated (—) | 55.1 |
| Mean Molecular Weight (g/mol) | 270.1 |

The transesterification reaction has been realised in three distinct steps each separated by a phase separation into a light FAME phase and a heavy glycerol phase. In this batch laboratory setting, it is not practical the recycle one or more of the glycerol heavy phases, that are separated after each step, to pre-treat the feedstock (in order to recover the catalytical activity that preferably migrates in the heavy glycerol phase). Consequently, as expected, more catalyst was necessary in order to achieve a satisfactory conversion of the feedstock. Indeed, 0.6% of catalyst was used compared to typically 0.4% in an industrial facility where such recycling is realised (usually in a continuous process). The feedstock (RBD palm oil, as described in table 1 was first pre-heated at 68° C. and transferred in a multi-neck batch reactor which was maintained at a temperature of 60° C. under an agitation of 200 rpm. The transesterification was carried out in three steps by addition of parts of the methanol and catalyst to the feedstock. The exact conditions are described in the table 2. After the set reaction time, a decantation was carried out at 60° C. and the light FAME phase was recovered and used as new feedstock for the next step of the transesterification. The heavy glycerol phase was discarded.

TABLE 2

Synthesis condition of the crude biodiesel samples utilised in examples 1a, 1b, 2a, 2b, 2c, 3a and 3b

| | Catalyst (dry basis) (wt. % to oil) | Relative catalyst distribution (wt. % total catalyst) | Methanol (wt. % to oil) | Relative methanol distribution (wt. % total methanol) | Reaction time (minutes) | Decantation time (minutes) |
|---|---|---|---|---|---|---|
| Step 1 | 0.30 | 50 | 13.02 | 60 | 45 | 60 |
| Step 2 | 0.21 | 35 | 5.43 | 25 | 45 | 30 |
| Step 3 | 0.09 | 15 | 3.26 | 15 | 60 | 60 |
| Total | 0.6 | 100 | 21.7 | 100 | 150 | 150 |

The third decantation consequently yields the final crude biodiesel which was furthermore flashed at reduced pressure to remove about 50% of its methanol content (during the phase separation, a part of the excess methanol remains in the light phase). This methanol flash evaporation is carried out at 65° C., 250 mbara for 10 minutes. Such methanol removal has the advantage of recovering economically a stream of dry methanol which, in an industrial setting, is recycled upstream. Several batches of crude biodiesel have been prepared with their characteristics presented in table 3. As a matter of fact, it can be seen that the properties of the different batches are totally within the specifications expected for industrial crude biodiesel. The properties are very similar for the different batches with notably a MAG concentration ranging from 0.45% to 0.49%. Furthermore, it can be seen that removing methanol induces a slight reverse reaction since the contents of the flashed crude biodiesel batches in partial glycerides are (moderately) higher that the ones of the non-flashed crude biodiesel batches.

TABLE 3

Composition of the crude biodiesel samples utilised in examples 1a, 1b, 2a, 2b, 2c, 3a and 3b

| Biodiesel Batch (FAME) | Methanol Flash | MAG (%) | DAG (%) | TAG (%) | Total Partial Glycerides (%) | Free Glycerol (%) | Total Glycerol (%) | MeOH (%) | Use |
|---|---|---|---|---|---|---|---|---|---|
| 1 | Before Flash | 0.42 | 0.07 | 0.02 | 0.51 | 0.005 | 0.13 | 6.2 | Not used in experiment |
| | After Flash | 0.46 | 0.11 | 0.03 | 0.60 | 0.004 | 0.14 | 3.3 | Used in examples 1a & 1b |
| 2 | Before Flash | 0.42 | 0.07 | 0.05 | 0.54 | 0.005 | 0.13 | 5.6 | Not used in experiment |
| | After Flash | 0.45 | 0.11 | 0.05 | 0.61 | 0.002 | 0.14 | 2.5 | Used in examples 2a & 2b |
| 3 | Before Flash | 0.42 | 0.07 | 0.05 | 0.54 | 0.005 | 0.13 | 5.6 | Not used in experiment |
| | After Flash | 0.47 | 0.14 | 0.06 | 0.67 | 0.004 | 0.15 | 2.9 | Used in examples 2c |
| 4 | Before Flash | 0.46 | 0.08 | 0.05 | 0.58 | 0.004 | 0.14 | 6.1 | Not used in experiment |
| | After Flash | 0.49 | 0.17 | 0.05 | 0.71 | 0.003 | 0.16 | 3.5 | Used in examples 3a & 3b |

Examples 1a and 1b: Double Washing with Water and Acidified Water

In example 1a, crude biodiesel (batch 1, after partial methanol flash evaporation) is successively washed firstly with distilled water and secondly with an acidified water solution containing 0.5% of citric acid (which corresponds to 300 ppm of acid in the biodiesel). As a matter of fact, the acid is firstly added to the crude biodiesel as a concentrated solution containing 30% of citric acid and the resulting mixture is intensively mixed during 1 minute in a high-shear mixer. After this initial intense mixing, the fresh distilled water is added, and the mixture transferred in a maturation vessel where the mixture is moderately agitated during 15 minutes at 60° C. under 200 rpm. Both washings are made with 6% of added water. The washing steps consist in mixing the crude biodiesel with the washing solution during 15 minutes at 60° C. under an agitation of 200 rpm. After each washing, the mixture is centrifuged for 15 min at 2,000 rpm. Those two washings reduce the MAG concentration from 0.46% to respectively 0.43% (after the first washing) and to 0.42% (after the second washing). This confirms that the standard washing procedure does not reduce the biodiesel' MAG concentration significantly even, if of course this procedure is efficient to neutralize and/or eliminate any residual catalyst species present in the crude biodiesel.

In example 1b, the same crude biodiesel (batch 1 after partial methanol flash evaporation) is also successively washed, but the first washing is realized with the recycled water obtained, by phase separation, after the second washing of example 1a. The second washing is realised with an acidified water containing 0.15% of citric acid (which corresponds to 100 ppm of acid in the biodiesel), which is added as a concentrate acid solution containing 30% of citric acid and initially intensively mixed for 1 minute using a high-shear mixer. Again, both washings are made with 6% of a water used counter-currently. Those two successive washings reduce the MAG concentration respectively from 0.46% to 0.43% and from 0.43% to the same value which illustrates that the second washing has no effect on the MAG reduction. This experiment again confirms that the standard washing procedure does not reduce the biodiesel' MAG concentration significantly and that utilising a recycled water has no benefit for the MAG reduction of the crude biodiesel.

In examples 1a and 1b, the washed biodiesel samples were further dried, and their specifications were within the specifications, except for the MAG content. All the results are summarised in table 4. It must be noted that this washing procedure has no or very limited impact on partial glycerides of the biodiesel. It indicates that no reverse reaction and, as well, no further transesterification took place.

TABLE 4

Double standard washing of crude biodiesel. Influence of counter-current recycling of second washing water.

| | Example 1a | | Example 1b | |
|---|---|---|---|---|
| Washing steps | 1st Washing | 2nd Washing | 1st Washing | 2nd Washing |
| Washing water composition | Distilled water | Acidified distilled water | Recycled from 2nd washing after phase separation from Example1a | Acidified distilled water |
| Washing water (%) (a) | 6 | 6 | 6 | 6 |
| Added 1.6 mol/l Citric Acid solution (%) (a) | — | 0.3 | — | 0.1 |
| Final Citric acid dosage (ppm) (b) | — | 300 | — | 100 |
| Initial contacting of citric acid solution with crude biodiesel | — | HSM (1 minute) | — | HSM (1 minute) |
| pH measured on water phase | 12.1 | 2.6 | 10.4 | 5.7 |
| Composition by GC (%) | | | | |
| Free glycerol | 0.005 | 0.005 | 0.005 | 0.004 |
| MAG | 0.43 | 0.42 | 0.43 | 0.43 |
| DAG | 0.11 | 0.11 | 0.11 | 0.11 |
| TAG | 0.02 | 0.03 | 0.03 | 0.04 |
| Bound glycerol | 0.13 | 0.13 | 0.13 | 0.13 |
| Total glycerol | 0.13 | 0.13 | 0.13 | 0.13 |
| ΣMAG + DAG + TAG | 0.56 | 0.56 | 0.57 | 0.58 |
| MAG reduction (%) | 6.5 | 8.7 | 6.5 | 6.5 |

(a) expressed as w/w % of crude biodiesel;
(b) expressed as w/w ppm of crude biodiesel

Examples 2a, 2b and 2c: Initial Caustic Washing with 1000 ppm of NaOH and Counter-Current Washing In examples 2a, 2b and 2c, counter-current double washings, realised with fresh or recycled washing aqueous solution are investigated, the first washing being realised in presence of an alkali. However, it has surprisingly been observed that the efficiency of the washing, at least for the reduction of MAG, is substantially improved if the alkali is contacted to the crude biodiesel in the form of a concentrated alkaline solution which is intensively mixed to said biodiesel during a short time (1 minute) in a high sheer mixer (HSM). In contrast, if the alkali is contacted to the crude biodiesel in the form of a diluted alkaline solution, the MAG reduction is less pronounced, even if the same quantity of alkali per unit of crude biodiesel is utilised (1000 ppm). This surprising observation can be drawn by comparing the results obtained for examples 2a and 2b and 2 b and 2c. Those results are compiled in table 5. In examples 2a and 2c, the crude biodiesel is contacted first with an alkali concentrated solution (leading to a MAG reduction of 66.7% and 68.1%) and in example 2b, the crude biodiesel is contacted with a diluted alkali solution (leading to MAG reduction of 44.4%). However, the total amount of alkali was the same in each example. The full details of those experiments and the discussion of the results are disclosed below.

In example 2a, crude biodiesel (batch 2 after partial methanol flash evaporation) is successively contacted with a concentrated alkaline solution and washed according to the following protocol: 0.33% of a 7.5 Mol/L NaOH aqueous solution is added to the biodiesel and the resulting mixture is directly high-shear mixed for 1 min. Then, this mixture is contacted with 6% (weight/weight of crude biodiesel) of distilled water and agitated for 15 minutes at 200 rpm at 60° C. After this moderate mixing, the mixture is separated by centrifugation for 15 min at 2000 rpm to yield a spent water and a pre-washed biodiesel. Then, the second washing is conducted on the obtained pre-washed biodiesel by contacting this one with a fresh acidic water containing citric acid, which is added as a concentrate acid solution containing 30% of citric acid and initially intensively mixed for 1 minute using a high-shear mixer (exact final concentrations reported in table 5). Directly after this intense mixing, 6% of distilled water is added and the resulting mixture is matured by agitating moderately for 15 min at 200 rpm and 60° C. The maturation is followed by a phase separation by centrifugation for 15 min at 2000 rpm and results in fully washed biodiesel and a water phase which is still acid. Finally, the fully purified biodiesel is dried by exposing it at low pressure and high temperature using a Rotavapor (125° C., 50 mbara, 30 min). The obtained dried and purified biodiesel is analysed with results included in table 5 (FAME phase). The MAG of the crude biodiesel has been reduced from 0.45% to 0.15% which represents the substantial reduction of 67%.

In example 2b, the washings procedure is nearly identical to the ones applied for example 2a with the difference that the concentrated solution of NaOH is not directly added to the crude biodiesel but mixed with the recycled water resulting from phase separation of the acid washing realised in example 2a (since all examples are based on batch experiments realised with laboratory equipment). Another difference compared to example 2a is that the second washing is realised with much less citric acid: 100 ppm instead of 300 ppm. Surprisingly, even if the same global quantity of caustic per unit of crude biodiesel is used, the MAG reduction is substantially less marked compared to example 2a. Indeed, final MAG concentration is 0.25% which corresponds to a reduction of only 44%.

In example 2c, the concentrations of the chemicals are identical to the ones used in example 2b but again, the caustic is added to the crude biodiesel (batch 3, after flash partial methanol evaporation) as a concentrated NaOH solution (0.33% a 7.5 Mol/L NaOH aqueous solution) and the resulting mixture is directly high-shear mixed for 1 min. Again, the MAG reduction is substantial (68%) and similar to the one observed in example 2a (67%). Example 2c confirms that the addition of the caustic solution in a concentrated form is advantageous for the reduction of MAG and allow the recycling of the water resulting from phase separation of the second acid washing. This use of a small volume of a concentrated solution of alkali (0.33% in example 2a and 2c), directly contacted to the crude biodiesel permits a substantial reduction of chemicals and of water needed for the washing of crude biodiesel compared to known processes.

It is also apparent that the MAG reduction result from the alkaline washing and not from the acid washing. Even if very little variation of MAG content can be observed after the second (acid) washing, it is believed that those small variations are due to normal experimental variances rather than due to a real effect of the acid washing.

In examples 2a, 2b and 2c, the spent water resulting from the phase separation realised after the first washing had a strongly alkaline pH which witnesses that the crude biodiesel contained a substantial alkalinity which indicates that the added NaOH is not fully consumed and does not react intensively with FAME. As a matter of fact, it can be calculated, from the pH of the various water phases, that, on a molar basis, the MAG reduction corresponds to a similar consumption of alkali. This observation indicates that MAG are probably saponified into soaps and glycerol and that since not significantly more alkali are consumed, no or at least very limited FAME saponification took place.

Indeed, when a crude biodiesel containing methanol and MAG is contacted with an alkali (NaOH) the two likely reactions of said MAG are the saponification and/or the transesterification.

In the case of MAG saponification (MAG+NaOH⇔NaSOAP+GLYCEROL), the NaOH is a reactant and consumed and the reacted NaOH will not contribute anymore to the pH of the water resulting from the washing of the crude biodiesel treated with the concentrated alkali solution.

In the case of MAG transesterification (MAG+MeOH⇔FAME+GLYCEROL), the NaOH acts as catalyst and is not consumed and therefore all the added NaOH will contribute to the pH of the water resulting from the washing of the crude biodiesel treated with the concentrated alkali solution.

Example 1a shows that there is some alkalinity left in the crude biodiesel. Indeed, if this one is washed with 6% of distilled water, the pH of the resulting decanted water is 12.1 which corresponds to 0.01 Mol/L of dissociated OH— in the spent water. Thus, we can assume the same level of alkalinity in the crude biodiesel batch used in example 2a. As a matter of fact, this alkalinity is relatively moderate since only 6% of water concentrated most of the alkalinity of the crude biodiesel.

It is observed that the pH of the spent water obtained in example 2a is 13.4 which corresponds to a concentration of 0.25 Mol/L of dissociated OH—.

Since we can assume that 0.01 Mol/L of dissociated OH— is coming from the crude biodiesel, we can assume that 0.25−0.01=0.24 Mol/L is coming from the added NaOH that ends up in the spent water.

In example 2a, 1000 ppm of NaOH have been added to the crude biodiesel, and any unconsumed (unreacted) NaOH will nearly fully transfer in the water phase during the washing. It is easy to calculate that if the NaOH is not consumed it will induce a concentration in NaOH in the spent water of 0.42 Mol/L (which would correspond to pH 13.6).

Further, in example 2a, the concentration in MAG has been decreased by 0.30% (from 0.45% to 0.15%). If we assume that this quantity is transformed into soaps and glycerol, a corresponding quantity of NaOH will be consumed (mole/mole). It can be calculated that, the resulting migration of the remaining NaOH in the spent water would be 0.27 Mol/L.

Since the measured value of the remaining alkalinity of the spent water (0.24 Mol/L) is very close to the theoretical one (based on the full saponification of the removed MAG which is 0.27 Mol/L), it is probable that the major mechanism leading to the removal of the MAG in the crude biodiesel is a saponification and that the transesterification with methanol is less frequent at least when the MAG content in the crude biodiesel is about 0.4% or less. It is also probable that biodiesel saponification is very limited since a substantial biodiesel saponification would have consumed an equivalent substantial amount of NaOH.

Therefore, from example 2a, it can indeed be concluded that, at least when the content of the treated crude biodiesel is about 0.4%, those MAG are mostly saponified and converted into soaps when said crude biodiesel is contacted with a concentrated solution of alkali.

TABLE 5

Double counter-current washing. Effect of the concentration of the alkali solution contacted with the crude biodiesel.

| | Example 2a | | Example 2b | | Example 2c | |
|---|---|---|---|---|---|---|
| Test Conditions | $1^{st}$ Washing | $2^{nd}$ Washing | $1^{st}$ Washing[3] | $2^{nd}$ Washing | $1^{st}$ Washing[3] | $2^{nd}$ Washing |
| Washing Water composition | Distilled water | Distilled water | Recycled from $2^{nd}$ washing Example 2a | Distilled water | Recycled from $2^{nd}$ washing Example 2a | Distilled water |
| Washing Water (%) (a) | 6 | 6 | 6 | 6 | 6 | 6 |

TABLE 5-continued

Double counter-current washing. Effect of the concentration of the alkali solution contacted with the crude biodiesel.

| Test Conditions | Example 2a 1st Washing | Example 2a 2nd Washing | Example 2b 1st Washing[3] | Example 2b 2nd Washing | Example 2c 1st Washing[3] | Example 2c 2nd Washing |
|---|---|---|---|---|---|---|
| Alkaline solution composition | 30% NaOH in water (7.5 Mol/L) | — | 30% NaOH in water (7.5 Mol/L) | — | 30% NaOH in water (7.5 Mol/L) | — |
| NaOH solution added to the crude biodiesel or to the recycled water (%) (a) | 0.33 | | 0.33 | | 0.33 | |
| Total NaOH dosage (ppm) (b) | 1000 | — | 1000 | — | 1000 | — |
| Citric Acid solution | — | 30% in water (1.6 Mol/L) | — | 30% in water (1.6 Mol/L) | — | 30% in water (1.6 Mol/L) |
| Added Citric Acid solution (%) (a) | | 0.3 | | 0.1 | | 0.3 |
| Total Citric acid dosage (ppm) (b) | — | 300 | — | 100 | — | 100 |
| Type of mixing of the concentrated NaOH or Citric acid solution (30%) with the crude biodiesel | Direct and before the washing (HSM 1 min) | Direct and before the washing (HSM 1 min) | NaOH solution is first mixed in the recycled water | Direct and before the washing (HSM 1 min) | Direct and before the washing (HSM 1 min) | Direct and before the washing (HSM 1 min) |
| pH measured on decanted water phase after washing | 13.4 | 2.7 | 13.3 | 4.4 | 13.2 | 3.3 |
| FAME Phase Composition by GC (%) | | | | | | |
| Free glycerol | Below detection limit | | | | | |
| MAG | 0.15 | 0.15 | 0.24 | 0.25 | 0.17 | 0.15 |
| DAG | 0.13 | 0.14 | 0.11 | 0.11 | 0.16 | 0.14 |
| TAG | 0.07 | 0.08 | 0.07 | 0.07 | 0.07 | 0.06 |
| Bound glycerol | 0.06 | 0.07 | 0.09 | 0.09 | 0.08 | 0.06 |
| Total glycerol | 0.06 | 0.07 | 0.09 | 0.09 | 0.07 | 0.06 |
| ΣMAG + DAG + TAG | 0.35 | 0.36 | 0.42 | 0.43 | 0.41 | 0.34 |
| MAG reduction (%) | 66.7 | 66.7 | 46.7 | 44.4 | 63.8 | 68.1 |

(a) expressed as w/w % of crude biodiesel;

(b) expressed as w/w ppm of crude biodiesel

Examples 3a and 3b (Diluted Caustic Washing with 1500 ppm NaOH)

In examples 3a and 3b, crude biodiesel (batch 4 after partial MeOH flash evaporation) is washed with a diluted caustic aqueous solution. However, more caustic is used since 1500 ppm (expressed as ppm in biodiesel) of caustic are diluted in 6% of distilled water (example 3a) or 6% of the recycled water (example 3b) resulting from the phase separation of the acid washing realised in example 2a. This diluted caustic solution is then contacted to the crude biodiesel with the same procedure used for the other examples. The second washing is realised with acidified distilled water (300 ppm of citric acid in example 3a or 100 ppm of citric in example 3b). Those two washing procedures lead to a reduction of MAG of 67%. Those examples demonstrated that using alkali in a diluted form required a higher global quantity of alkali (per unit of crude biodiesel) to obtain the same reduction of the MAG when the crude biodiesel is contacted with a concentrated alkali solution corresponding to 1000 ppm of NaOH. Those examples also demonstrated that the recycling of washing water (i.e., the recycled water) resulting from phase separation of the acid washing (second washing) does not reduce the intermediate or the final reduction of MAG. Indeed, in examples 3a and 3b, the same MAG reduction is observed either after the first and second washing. In other words, the remaining slight acidity contained in the recycled water has no impact on the MAG reduction since only a non-substantial quantity of alkalinity is neutralised by this slight acidity and therefore the majority of the added alkalinity is still available to react with the MAG. Calculation indicates that less than 1% of the added alkalinity is neutralised by the remaining acidity of the recycled water. Results related to examples 3a and 3b are compiled in table 6.

TABLE 6

Double counter-current washing. Effect of the recycling of washing water (i.e., the recycled water).

| | Test | | | |
|---|---|---|---|---|
| | Example 3a | | Example 3b | |
| Conditions | 1st Washing[3] | 2nd Washing | 1st Washing[3] | 2nd Washing |
| Washing Water | Distilled water | Distilled water | Recycled from 2nd washing Ex 3a | Distilled water |
| Water (%) (a) | 6 | 6 | 6 | 6 |
| Alkaline solution composition | 30% w/w NaOH in water (7.5 Mol/L) | — | 30% w/w NaOH in water (7.5 Mol/L) | — |
| NaOH dosage (ppm) (b) | 1500 | — | 1500 | — |
| NaOH solution added to the washing water (%) (a) | 0.5 | | 0.5 | |
| Acid solution | — | 30% in water | — | 30% in water |
| Citric acid dosage (ppm) (b) | — | 300 | | 100 |
| Type of mixing of the concentrated NaOH (30%) with the biodiesel | Diluted: The 30% NaOH solution is first mixed in the distilled water before contacting biodiesel | Concentrated: Direct and before the washing (HSM 1 min) | Diluted: The 30% NaOH solution is first mixed in the recycled water before contacting biodiesel | Concentrated: Direct and before the washing (HSM 1 min) |
| pH measured on water phase | 13.6 | 3.2 | 13.6 | 4.5 |
| FAME Phase Composition by GC (%) | | | | |
| Free glycerol | 0.0003 | Below detection limit | | |
| MAG | 0.16 | 0.16 | 0.16 | 0.16 |
| DAG | 0.13 | 0.14 | 0.13 | 0.13 |
| TAG | 0.06 | 0.06 | 0.06 | 0.07 |
| Bound glycerol | 0.07 | 0.07 | 0.07 | 0.07 |
| Total glycerol | 0.07 | 0.07 | 0.07 | 0.07 |
| ΣMAG + DAG + TAG | 0.35 | 0.36 | 0.35 | 0.36 |
| MAG reduction (%) | 67.3 | 67.3 | 67.3 | 67.3 |

(a) expressed as w/w % of crude biodiesel;
(b) expressed as w/w ppm of crude biodiesel

Examples 4a and 4b (Caustic Washing with a Diluted Alkaline Solution of a Methanol Depleted Crude Biodiesel)

Examples 4a and 4b show the influence of a significant depletion of methanol in the crude biodiesel on the MAG reduction and on its saponification. To be able to show those mechanisms more precisely and convincingly, a crude biodiesel containing a higher concentration of MAG is needed. Therefore, two crude biodiesel batches have been synthetised in two stages instead of three resulting in a substantially higher contamination with MAG (1.71% and 1.52% respectively). This crude biodiesel has been fully washed with an acidified water (in order to deactivate any residual catalytic activity remaining in the biodiesel and preclude any reverse reaction caused by the initial presence of residual catalyst in the crude biodiesel, and then fully vacuum dried the reduce water and MeOH to very low content (500 ppm). Since the biodiesel contains high content of MAG, a more concentrated solution of alkali has been used (2500 ppm and 3370 ppm respectively).

Example 4a shows that contacting and mixing intensively a concentrated solution of alkali to a methanol-depleted biodiesel allows to reduce its MAG concentration from 1.71% to 0.33% (after a water washing). Therefore, it can be concluded that the presence of MeOH in the crude biodiesel is not mandatory to achieve a substantial reduction of MAG, as long as a sufficient quantity of alkali is contacted to the crude biodiesel. Furthermore, the analysis of the water phase resulting from the water washing reveals the presence of glycerol (0.19%), which demonstrates and confirms that the MAG are saponified when contacted with a concentrated solution of alkali. Furthermore, this water phase also contains MeOH which indicates that a very small proportion of FAME have been saponified as well (corresponding to 23 ppm of methanol). However, the real methanol content in the fully washed biodiesel is most probably under-evaluated since it is likely that part of the methanol is lost by evaporation during the washing and related manipulations. Indeed, methanol is very volatile. Furthermore, it cannot be excluded that some MAG reacted with the biodiesel to produce DAG and methanol.

Example 4b confirms the results obtained with example 4a: as a matter of fact, a more concentrated alkaline solution has been used resulting in an even larger reduction of MAG and the apparition of more glycerol in the water phase resulting from the water washing. Methanol content was not obtained due to a deficiency of the analytic equipment. Results obtained for examples 4a and 4b are compiled in table 7.

It must be noted that in examples 4a and 4b, a single washing, with distilled water, has been realised after the treatment with the concentrated alkali solution in order to be able to perform optimal analysis on the resulting spent water. This methodology is legit since it has been established previously that the second acid washing has no influence on the MAG reduction.

TABLE 7

| Caustic washing with diluted alkaline solution of a methanol depleted crude biodiesel | | | | |
|---|---|---|---|---|
| | Example 4a | | Example 4b | |
| | "Crude" Biodiesel (Washed & Dried) | Post-treated Biodiesel | "Crude" Biodiesel (Washed & Dried) | Post-treated Biodiesel |
| Composition of the NaOH solution (added directly) | — | 30 w/w % NaOH in water (7.5 Mol/L) | — | 30 w/w % NaOH in water (7.5 Mol/L) |
| NaOH solution added to the biodiesel (%) (a) | | 0.825 | | 1.12 |
| NaOH dosage (ppm) (b) | — | 2500 | — | 3370 |
| Washing Water (%) (a) | — | 6 | — | 6 |
| FAME Phase Composition by GC (%) | | | | |
| Free glycerin | 0.006 | N.D. (c) | 0.006 | N.D. (c) |
| MAG | 1.71 | 0.33 | 1.52 | 0.15 |
| DAG | 1.78 | 2.31 | 1.51 | 1.97 |
| TAG | 2.30 | 2.29 | 1.76 | 1.80 |
| Bound glycerin | 0.93 | 0.66 | 0.79 | 0.51 |
| Total glycerin | 0.94 | 0.66 | 0.80 | 0.51 |
| ΣMAG + DAG + TAG | 5.79 | 4.93 | 4.80 | 3.93 |
| MAG reduction (%) | — | 80.7 | — | 90.1 |
| Water Phase composition | | | | |
| pH (—) | — | ~10 | — | ~11-12 |
| Glycerol content (% by Ea 6-51 method) (d) | — | 0.19 | — | 0.49 |
| Methanol content (ppm - by HSS method) (d) | — | 523 | — | N.A (f) |

(a) expressed as w/w % of crude biodiesel;
(b) expressed as w/w ppm of crude biodiesel;
(c) N.D.: Non detectable;
(d) expressed as % or ppm in FAME phase;
(f) N.A.: Not available

Examples 5a and 5b (Specific Influence of Methanol Concentration in Crude Biodiesel on the MAG Reduction)

Examples 5a and 5b aim at showing the specific influence of the presence of methanol in the crude biodiesel and if the process according to the present invention is able to reduce the MAG residual content of biodiesel to very low values even if the starting crude biodiesel contains the maximal content in MAG that can been found in commercial biodiesel.

Therefore, two crude biodiesel batches have been synthetised with MAG content reaching 0.8 to 0.9% in order to check if the process according to the present invention is still able to reduce the concentration of MAG remaining in the post-treated biodiesel to value below 0.4% and even preferably below 0.2% with limited amount of alkali, and, furthermore, to determine the specific influence of the presence of methanol in said crude biodiesel on the MAG reduction. Again, in examples 5a and 5b the crude biodiesel samples have been fully washed with an acidified water, in order to deactivate any residual catalytic activity remaining in the biodiesel and then fully vacuum dried the reduce water and MeOH to very low content (500 ppm). However, for example 5b, a controlled amount of MeOH (20,000 ppm) has been added to this fully washed and dried biodiesel.

It has been observed that, the reduction of MAG induced by contacting those crude biodiesel samples with a concentrated alkali solution (2,000 ppm) is significantly more important when methanol is added to said crude biodiesel i.e., in the case of the example 5b. It is probable that the presence of MeOH in the biodiesel induces the transesterification of the MAG into FAME, and this mechanism comes in addition to their saponification. The combination of those two mechanisms results in a superior reduction of MAG when the crude biodiesel contains a substantial amount of methanol. As a matter of fact, it is probable that the transesterification induced by the presence of substantial amount of methanol induces the decrease of DAG and TAG in the post-treated biodiesel while, the DAG and TAG concentration increases for the methanol depleted crude biodiesel which may confirm the occurrence of MAG reacting with the biodiesel to produce DAG and methanol. Therefore, the presence of methanol in the crude biodiesel is advantageous since it enhances the removal of residual MAG (and possibly DAG and TAG) in the post-treated biodiesel and furthermore may induces the conversion of a fraction of those MAG into FAME which corresponds to a yield improvement compared to a MAG reduction relaying solely on saponification since the resulting soaps and glycerol are then removed from the FAME phase during the subsequent washing. Furthermore, the results obtained for example 5b are also consistent with an absence of FAME saponification during the treatment with the concentrated alkali solution. Indeed, the remaining concentrations of MeOH in the post-treated biodiesel (4,900 ppm), and water phase (12,239 ppm) are consistent with a consumption of some MeOH during the esterification of MAG, DAG and TAG. On the opposite, the presence of MeOH in the water phase (503 ppm) for example 5a, taking into account that this amount is most likely under-evaluated, is again consistent with some FAME saponification when the starting crude biodiesel contains only very limited amount of methanol.

TABLE 8 specific influence of methanol concentration in crude biodiesel on the MAG reduction

| | Test | | | |
|---|---|---|---|---|
| | Test 5a | | Test 5b | |
| Conditions | Washed/Dried Crude Biodiesel | Treated Biodiesel | Washed/Dried Crude Biodiesel | Treated Biodiesel |
| Added methanol (ppm) | — | 0 | — | 20,000 |
| Composition of the NaOH solution (added directly) | — | 30 w/w % in water (7.5 Mol/L) | — | 30 w/w % in water (7.5 Mol/L) |
| NaOH solution added to the biodiesel (%) (a) | | 0.66 | | 0.66 |
| NaOH dosage (ppm) (b) | — | 2000 | — | 2000 |
| Added Washing Water (a) | — | 6 | — | 6 |
| "Crude" FAME Phase after phase separation | | | | |
| Methanol content by HSS (%) | — | 115 | — | 4,900 |
| FAME Phase (washed and dried) after phase separation | | | | |
| Composition by GC (%)[1] | | | | |
| Free glycerin | 0.004 | 0.001 | 0.005 | 0.001 |
| MAG | 0.85 | 0.28 | 0.87 | 0.11 |
| DAG | 0.45 | 0.68 | 0.44 | 0.20 |
| TAG | 0.52 | 0.53 | 0.46 | 0.26 |
| Bound glycerin | 0.34 | 0.23 | 0.33 | 0.08 |
| Total glycerin | 0.34 | 0.23 | 0.34 | 0.09 |
| ΣMAG + DAG + TAG | 1.82 | 1.49 | 1.77 | 0.57 |
| MAG reduction (%) | — | 67.1 | — | 87.4 |
| Water Phase composition | | | | |
| pH (—) | — | ~13 | — | ~13 |
| Glycerol content (% by Ea 6-51 method) (c) | — | 0.15 | — | 0.36 |
| Methanol content (ppm - by HSS method) (c) | — | 503 | — | 12,239 |

(a) expressed as w/w % of crude biodiesel;
(b) expressed as w/w ppm of crude biodiesel;
(c) expressed as % or ppm in the FAME phase Thus, the present invention provides a particularly economical process in which the same water is contacted two times counter-currently to the processed biodiesel. It has been found that 3 to 6% of water is sufficient to perform an efficient washing. Furthermore, surprisingly, the increased efficiency of a concentrated alkali solution compared to a diluted one, for the reduction of MAG below 0.4%, even below 0.2% when contacted to the crude biodiesel further reduce not only the alkali needed during this post-treatment per se but also reduce the subsequent needed acid to neutralise any alkalinity still present in the pre-washed biodiesel. Consequently, the process according to the present invention is particularly economical in chemicals and water consumption while performing a significant MAG reduction. Furthermore, the present process may convert some of the MAG present in the crude biodiesel into biodiesel (such as FAME). The present process does not induce a significant saponification of the biodiesel. Consequently, the process is able to deliver a stable biodiesel with improved filtration characteristics that can be safely blended in high proportion with petrodiesel. Finally, the implementation of the present process in existing production facilities is straightforward and does not necessitate large equipment and substantial investment.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Each of the components or methodologies described above may be combined or added together in any permutation. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A post-treatment process for crude biodiesel containing residual monoacylglycerol (MAG) and comprising the steps of:

(a) providing a crude biodiesel;

(b) contacting said crude biodiesel with a concentrated alkaline solution, and agitating the resulting mixture, to obtain a concentrated alkaline treated biodiesel;

(c) contacting said concentrated alkaline treated biodiesel of step (b) with a recycled water and agitating the resulting mixture to obtain a first agitated mixture;

(d) phase separating said first agitated mixture resulting from step (c) to obtain a pre-washed biodiesel and a spent water phase;

(e) contacting said pre-washed biodiesel of step (d) with acidic water and agitating the resulting mixture to obtain a second agitated mixture;

(f) phase separating said second agitated mixture of step (e) to obtain a water phase which is recycled in step (c) as said recycled water, and a fully washed biodiesel; and (g) drying said fully washed biodiesel of step (f) to obtain a purified biodiesel, wherein, the concentrated alkaline solution used in step b) is at least 5 mol/L and a volume of the concentrated biodiesel of step (f) is max 1% of the volume of said crude biodiesel, and wherein the residual concentration in MAG of the purified biodiesel does not exceed 0.4%.

2. The process according to claim 1, wherein the crude biodiesel from step (a) is fatty acid methyl esters (FAME) and results from the transesterification of a fatty material with methanol, said transesterification being catalysed by an alkaline.

3. The process according to claim 1, wherein the crude biodiesel from step (a) is FAME and results from the transesterification of a fatty material with methanol, said transesterification being catalysed by an alkaline catalyst and still contains 1% to 4% of residual methanol.

4. The process according to claim 1, wherein the crude biodiesel from step (a) is FAME and results from the transesterification of a fatty material with methanol, said transesterification being catalysed by an alkaline catalyst and said transesterification being further carried out in several steps, each step being ended by a phase separation of a light crude FAME phase and a heavy glycerol phase.

5. The process according to claim 1, wherein the crude biodiesel from step (a) is FAME and results from the transesterification of a fatty material with methanol, said transesterification being catalysed by an alkaline catalyst and said transesterification being further realised in several steps, each step being ended by a phase separation of a light crude FAME phase and a heavy glycerol phase, and the final light crude FAME does not contain more than 0.5% of residual glycerol but more than 0.4% of MAG.

6. The process according to claim 1, wherein the mixture of step (b) resulting from the contact of the crude biodiesel with a concentrated alkaline solution is agitated with a high-shear mixing device, under vigorous to violent agitation intensity during a period ranging from 0.1 minute to 5 minutes.

7. The process according to claim 1, wherein the mixture of step (b) resulting from the contact of the crude biodiesel with a concentrated alkaline solution is agitated in a cavitation reactor, said agitation being maintained during a period ranging from 0.01minute to 0.1 minute.

8. The process according to claim 1, wherein the first and/or second agitated mixture(s) of step (c) and/or step (e) is/are agitated under mild to moderate intensity for a period ranging from 1 minute to 60 minutes.

9. The process according to claim 1, wherein the reduction of MAG is achieved through saponification with an alkali transforming said MAG into soap and/or through transesterification with MeOH transforming said MAG into FAME.

10. The process according to claim 1, wherein said process is continuous and the concentrated alkali solution of step b) is contacted in line to the crude biodiesel with the use of a metering pump.

11. The process according to claim 1, wherein the residual concentration in MAG of the purified biodiesel does not exceed 0.2%.

12. The process according to claim 2, wherein the alkaline catalyst is sodium methoxide.

* * * * *